US010376721B2

(12) United States Patent
Janowiak et al.

(10) Patent No.: US 10,376,721 B2
(45) Date of Patent: Aug. 13, 2019

(54) GEAR LOOP

(71) Applicant: Irvin Automotive Products, Inc., Pontiac, MI (US)

(72) Inventors: Anthony R. Janowiak, Rochester Hills, MI (US); David L. Huff, Waterford, MI (US); Jason William Barnes, Pontiac, MI (US)

(73) Assignee: Irvin Automotive Products, LLC, Pontiac, MI (US)

( * ) Notice: Subject to any disclaimer, the term of this patent is extended or adjusted under 35 U.S.C. 154(b) by 348 days.

(21) Appl. No.: 14/529,274

(22) Filed: Oct. 31, 2014

(65) Prior Publication Data

US 2016/0121147 A1 May 5, 2016

(51) Int. Cl.
*A62B 35/00* (2006.01)

(52) U.S. Cl.
CPC ..... *A62B 35/0025* (2013.01); *A62B 35/0012* (2013.01)

(58) Field of Classification Search
CPC . A62B 35/00; A62B 35/0006; A62B 35/0025; A62B 35/0012; A62B 35/0018; A62B 35/0031; A62B 35/0037; A62B 35/0043; A62B 35/0068; A62B 35/0075
See application file for complete search history.

(56) References Cited

U.S. PATENT DOCUMENTS

| | | | | | |
|---|---|---|---|---|---|
| 2,345,371 | A * | 3/1944 | Amrine | B29C 70/58 | 16/444 |
| 3,183,549 | A * | 5/1965 | Hammesfahr | A45C 13/26 | 16/442 |
| 4,364,150 | A * | 12/1982 | Remington | A45C 13/26 | 16/409 |
| 5,370,288 | A | 12/1994 | Field | | |
| 5,411,461 | A | 5/1995 | Thomascik | | |
| 5,445,114 | A | 8/1995 | Walker | | |
| 5,528,795 | A * | 6/1996 | Gramegna | A45C 13/26 | 16/408 |
| 5,615,750 | A | 4/1997 | Phillips | | |
| 5,639,005 | A | 6/1997 | Chouinard | | |
| 5,781,956 | A * | 7/1998 | Kelsay | B25G 1/102 | 15/143.1 |
| 5,961,017 | A | 10/1999 | Mehler | | |
| 6,050,364 | A | 4/2000 | Popall et al. | | |
| 6,283,248 | B1 | 9/2001 | Groover | | |
| 6,481,528 | B2 | 11/2002 | Antonio | | |
| 6,604,256 | B1 * | 8/2003 | Pytlewski | B25G 3/36 | 15/143.1 |
| 6,732,834 | B2 | 5/2004 | Colorado | | |
| 6,988,694 | B2 * | 1/2006 | Barrs | B63B 35/7979 | 114/39.18 |

(Continued)

*Primary Examiner* — Katherine W Mitchell
*Assistant Examiner* — Shiref M Mekhaeil
(74) *Attorney, Agent, or Firm* — Raggio & Dinnin, P.C.

(57) ABSTRACT

A gear loop for use in a climbing harness or any other recreational or commercial harness or belt and generally comprises a U shaped body, wherein the body is made of a first predetermined material. The gear loop body also has a first end and a second end. The gear loop further comprises an end member attached to the first end and the second end of the body. The end member is made of a second predetermined material. The end member is formed, such that it allows the gear loop to fold in a predetermined direction with relation to a harness.

15 Claims, 4 Drawing Sheets

(56) References Cited

U.S. PATENT DOCUMENTS

| | | | | |
|---|---|---|---|---|
| 7,445,085 | B2 | 11/2008 | Petzl et al. | |
| 7,967,109 | B2 * | 6/2011 | Petzl | A62B 35/0037 182/3 |
| 8,025,192 | B2 | 9/2011 | Petzl et al. | |
| 8,292,029 | B2 | 10/2012 | Martin | |
| 8,333,262 | B1 | 12/2012 | Carpenter et al. | |
| 8,443,937 | B2 | 5/2013 | Mordecai et al. | |
| 8,459,518 | B2 | 6/2013 | Demsky | |
| 8,490,251 | B2 * | 7/2013 | Manuel | B25G 1/102 16/114.1 |
| 8,851,232 | B2 | 10/2014 | Raoul Bingham | |
| 2002/0038811 | A1 * | 4/2002 | Vigny | A45F 3/04 224/651 |
| 2007/0163079 | A1 * | 7/2007 | Cude | B65D 25/2826 16/114.1 |
| 2015/0233143 | A1 * | 8/2015 | Johnson | E05B 1/04 16/412 |

* cited by examiner

GEAR LOOP

BACKGROUND OF THE INVENTION

1. Field of the Invention

The present invention generally relates to gear loops, and more particularly relates to a gear loop for use on a climbing harness and the like.

2. Description of Related Art

Gear loops have been known for many years in the art. One prior art gear loop for use on a harness is achieved by means of a continuous cord fixed by seams along the lining structure of a harness, thus forming a succession of attachment loops. The prior art also has gear loops that are made of several pieces of cloth of rectangular shape being sewn onto a belt and at the same time forming pockets. These prior art loops with the belts are very complicated and are costly to manufacture. The prior art also has gear loops for carrying equipment of a roping belt or climbing harness that use fractionated straps securely attached individually along the belt. However, in these prior art fractionally strapped gear loops, each strap has to be fixed to the belt by means of extremely solid seams, thus each strap has to have a high individual strength, but this leads to increased weight and the increased manufacturing costs for gear loops.

Climbing harnesses have been known for many years and are used for a variety of recreational and commercial purposes. Generally, the recreational uses may include mountain climbing, exploration of caves, bouldering, etc., while the commercial purposes may include high rise window washing, emergency service rescues, construction work, etc. A great variety of climbing harnesses exist. Some of these harnesses, particularly those used for commercial purposes, may be full body harnesses, which include shoulder and chest straps as well as a waist band and leg loops. Other harness may only be a simple waist band, such as one that might be worn as a safety harness by a person participating in a climbing wall activity. It should also be noted that climbing harnesses, which may be used for recreation, may be used in a variety of environments. Alpinists may require harnesses which may be put on and removed over heavy boots and/or skis. Climbers who explore caves may require harnesses which are flexible and resistant to abrasion, which are also comfortable when partially or fully submerged in water. It should be noted that the primary purpose of any climbing harness or work harness, whether for recreation or commercial use, may be to prevent gravity from having an adverse effect on the climber. To this end, the climbing harness must be both functional and comfortable and must include the necessary safety measures built in along with the necessary gear loops in order to allow for the climber to have the necessary tools at the ready to ensure safe climbing.

The gear loops used on climbing harnesses are generally meant to hold certain pieces of climbing apparatuses, especially carabiners, extra rope, lock rings, etc., while a person is ascending or descending their latest challenge either in a cave, on a cliff side, etc. Generally, the carabiners clip on to the gear loop and are ready to be removed as the climber needs one. The current prior art design for gear loops generally includes some type of nylon webbing that is threaded through a formed clear plastic tube, which is then sewn to the climbing harness belt at the end of the webbing. Generally, these prior art gear loop assemblies may give and fold back toward the climber if they are in tight quarters, or may be used to reduce wear against the rocks one encounters during the climbing activity. Therefore, there is a need in the art for an improved gear loop for use in climbing and other activities. There also is a need in the art for a two shot plastic loop that is more robust and uses a type of hinge to ensure the gear loop will fold back toward the climber when the climber is in tight quarters or is against rocks, thus reducing wear and increasing the durability and useful life of the gear loop. There also is a need in the art for a gear loop that is sewn to the belt through a flat/slot section arranged on each end of the gear loop. There also is a need in the art for a low cost, easy to manufacture and assemble gear loop for use with a climbing harness or the like.

SUMMARY OF THE INVENTION

One object of the present invention may be to provide a novel and unique gear loop.

Another object of the present invention may be to provide a gear loop that is for use on any type of harness or belt, such as a climbing harness.

Still another object of the present invention may be to provide a gear loop that may be used for a variety of recreational activities and commercial activities, such as on a climbing harness or the like.

Still another object of the present invention may be to provide a gear loop that is designed to be a two shot plastic loop.

Still another object of the present invention may be to provide a gear loop that includes a body section molded from a UV stable plastic material.

Still another object of the present invention may be to provide a gear loop that includes an end member molded from a thermoplastic elastomer material.

Still another object of the present invention may be to provide a gear loop that uses an end member to serve as a type of hinge that may allow the gear loop to fold back toward a climber when the climber is in tight quarters, thus helping to reduce the wear against the rocks one encounters during climbing activities.

Still another object of the present invention may be to provide a gear loop that is sewn to the belt or waist band portion of a climbing harness through a flat slotted end member arranged on each end of the gear loop.

Still another object of the present invention may be to provide a gear loop that includes a spine and rib configuration arranged on a back side thereof.

Still another object of the present invention may be to provide a gear loop that is easier to manufacture and assemble onto an existing climbing harness.

Still another object of the present invention may be to provide a gear loop that is more robust and has a longer life than prior art gear loops.

According to the present invention, the foregoing and other objects and advantages are obtained by a novel design for a gear loop for use on a harness. The gear loop generally comprises a U-shape body, wherein the body is made of a first predetermined material. The body also has a first end and a second end. The gear loop further comprises an end member attached to the first end and the second end of the body. The end member is made of a second predetermined material. The end member allows the gear loop to fold in a predetermined direction with respect to the user of the climbing harness.

One advantage of the present invention may be that it provides a novel and unique gear loop.

Another advantage of the present invention may be that it provides for a gear loop that is used in conjunction with a climbing harness.

Still another object of the present invention may be that it provides for a gear loop that is used in a variety of recreational and commercially purposed climbing harnesses or belts.

Still another advantage of the present invention may be that it provides for a gear loop that has a two shot plastic loop that performs similar functions to prior art nylon webbing/rope designed gear loops.

Still another advantage of the present invention may be that it includes a body molded from a UV stable plastic material.

Still another advantage of the present invention may be that it provides a gear loop that has an end member molded from a thermoplastic elastomer.

Another advantage of the present invention may be that it provides for a gear loop that may serve as a type of hinge that may let the gear loop fold back toward a climber when the climber is in tight quarters, which may allow for reduction in the wear of the gear loop against rocks one encounters during climbing activities.

Still another advantage of the present invention may be that it provides a gear loop that is sewn to the climbers belt through a flat and slotted end member section of the gear loop.

Still another advantage of the present invention may be that it provides a gear loop that is more robust and easier to manufacture.

Still another advantage of the present invention may be that it provides a gear loop that reduces the cost of manufacturing and the assembly time necessary to attach the gear loop to a climbing harness.

Still another advantage of the present invention may be that it provides a gear loop that has a spine and rib configuration arranged on a back side of a body of the gear loop.

Other objects, features and advantages of the present invention may become apparent from the subsequent description and the appended claims, taken in conjunction with the accompanying drawings.

DESCRIPTION OF THE EMBODIMENT(S)

Figure 1:
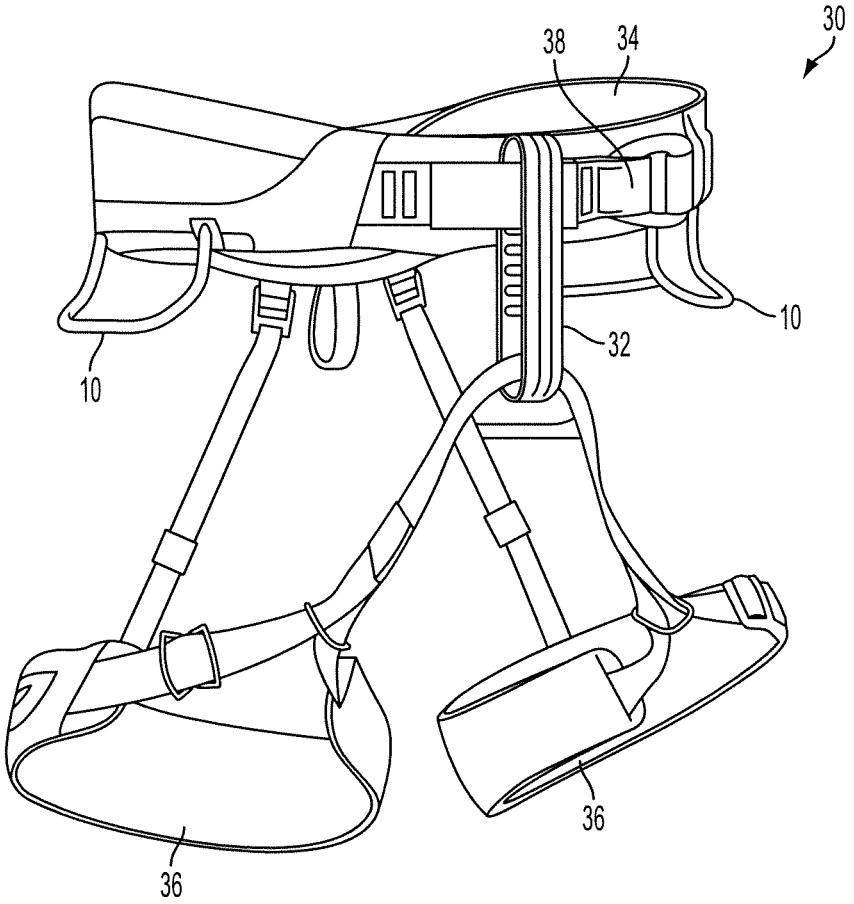
FIG. 1 shows a perspective view of a gear loop on a climbing harness according to the present invention.
Figure 2:
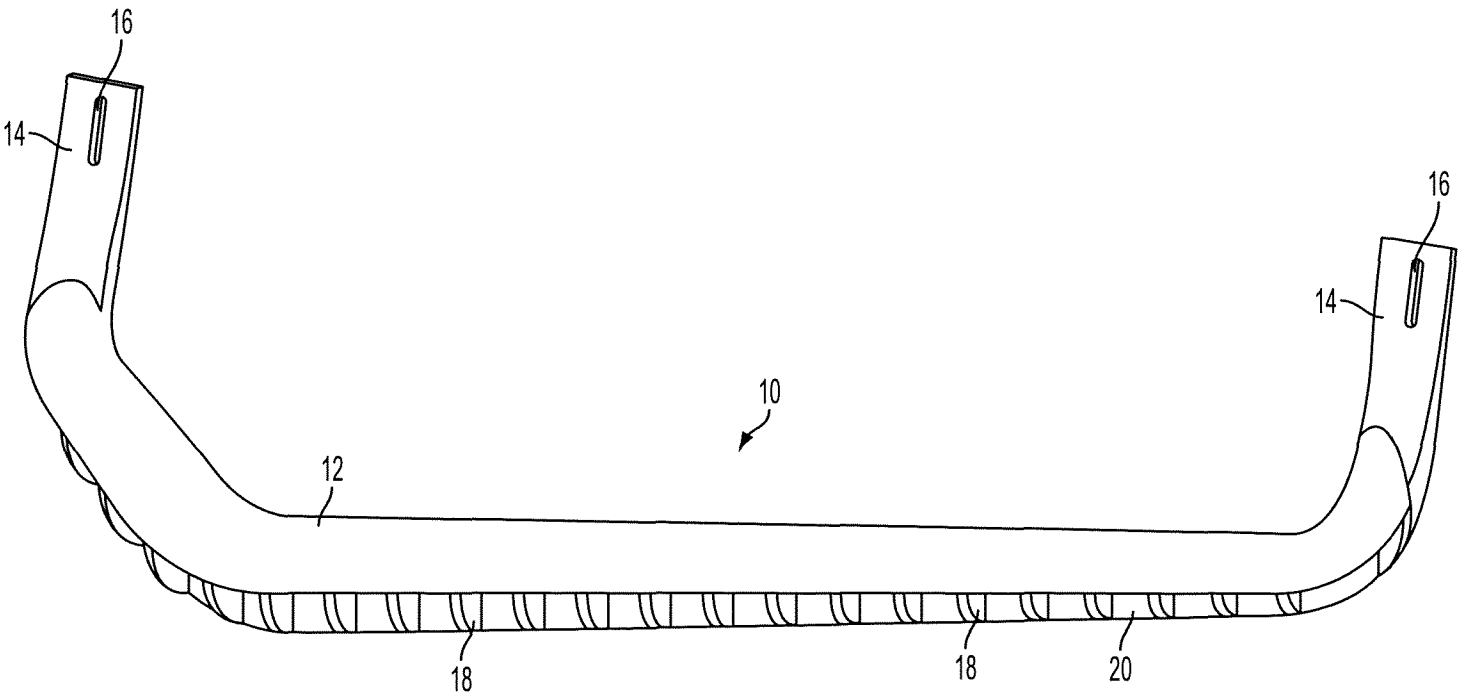
FIG. 2 shows a perspective view of a gear loop according to the present invention.
Figure 3:
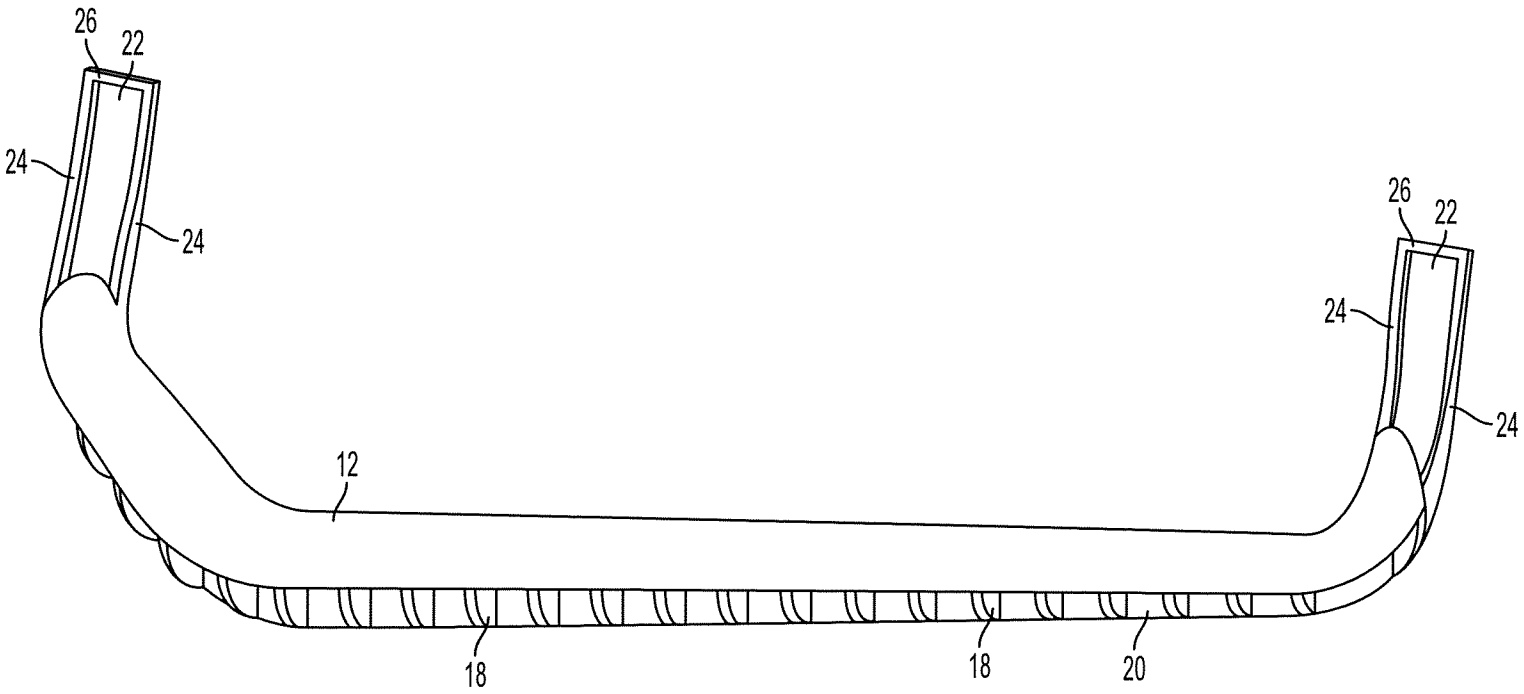
FIG. 3 shows a perspective view of a body of a gear loop according to the present invention.

Referring to the drawings, a gear loop 10 is shown according to the present invention. The gear loop 10 generally is made of a two shot plastic loop that performs similar functions to prior art nylon webbing gear loops. It should be noted that the gear loop 10 of the present invention may be used for any variety of recreation or climbing purposes or applications. Generally, the gear loop 10 may be used with a climbing harness 30, but may be used for mountain climbing, exploration of caves, high rise window washing, emergency service rescues or any other type of activity that one may use a belt or harness and requires the ability to store the necessary equipment for the activity within arms reach, such that it is easily accessible by connecting to a gear loop 10 attached to a belt or the like. It is also contemplated that the gear loop 10 may be used on tool belts or work belts for use by construction workers, firemen, policemen or any other type of occupation or recreation that the user needs quick access to tools that are hung or connected to a belt or harness worn by the user.

In one contemplated embodiment and as shown in FIG. 1, the gear loop 10 of the present invention may be used on a climbing harness 30. Generally, the climbing harness 30 includes a waist band or belt 34 and a pair of leg loops 36, extending from the waist band 34 thereof. The waist band 34 generally may include an adjustable closing strap 38 that is capable of adjusting to different size waists and different size users of the climbing harness. It should be noted that a variety of different webbings and webbed belts may be arranged around the climbing harness waist band 34 and the waist band 34 may also include a padded portion to which the webbed belt 38 or the like may be secured. The closing strap 38 may be any type of closing strap that allows for adjustment of the tightness of the climbing waist band 34 around the climbers waist. The climbing harness 30 may also include a belay loop 32 that is attached to the waist band 34. The belay loop 32 may be secured to any portion of the waist band 34 depending on the design requirement of the climbing harness 30. The climbing harness 30 may also include a pair of leg loops 36 wherein each includes a first free end, respectively, and a second free end, respectively. In one embodiment each leg loop 36 is generally formed of a length of webbing which is tapered by means of a fold and connects to a predetermined portion of the waist band 34 in a rear thereof and to the belay loop 32 on a front portion of the leg loop 36. It should be noted that each of the leg loops 36 generally may be adjustable via any known buckle or mechanical component to securely fasten one leg loop 36 around the left leg and one leg loop 36 around the right leg of the climber using the climbing harness 30. The buckles may be used to tighten the leg loop 36 to a comfortable position with relation to each leg. The climbing harness 30 may also include other connectors that are used to ensure that if the climber slips or falls during the ascent or descent on a rock wall, in a cave, etc., that the climbing harness 30 may secure and hold the climber against falling, via gravity, to the ground, thus incurring injury to the climber.

The climbing harness 30 in the embodiment shown may also include at least one gear loop 10. Generally, the gear loops 10 are provided and arranged anywhere on the waist band 34 and are intended to provide storage locations for implements, tools, such as but not limited to carabiners, hook ins, etc., which a climber may require during a climbing expedition. It should be noted that the gear loops 10 generally are non-structural, and are not intended to support any significant weight, such as the weight of the climber during a fall from the rock wall. In the embodiment shown the gear loops 10 may be secured to a predetermined portion of the waist band 34, preferably a webbed belt portion of the waist band 34, via sewing each end of the gear loop 10 with a predetermined stitch and thread to the waist band 34. It is contemplated to have at least one gear loop 10 arranged on the waist band 34, but it is also contemplated to have multiple gear loops 10 arranged at various positions around the waist band 34 or any other portion of the climbing harness 30. It should be noted that any known thread type or stitch may be used to secure each end of the gear loop 10 to the waist band 34 in the embodiment described. It is also contemplated to use any other method other than sewing to secure the gear loops 10 to the waist band 34 of the climbing harness 30, such as but not limited to any known mechanical or chemical fastening technique, such as rivets, screws, bolts, nails, staples, epoxies, glues, or the like.

Figure 4:
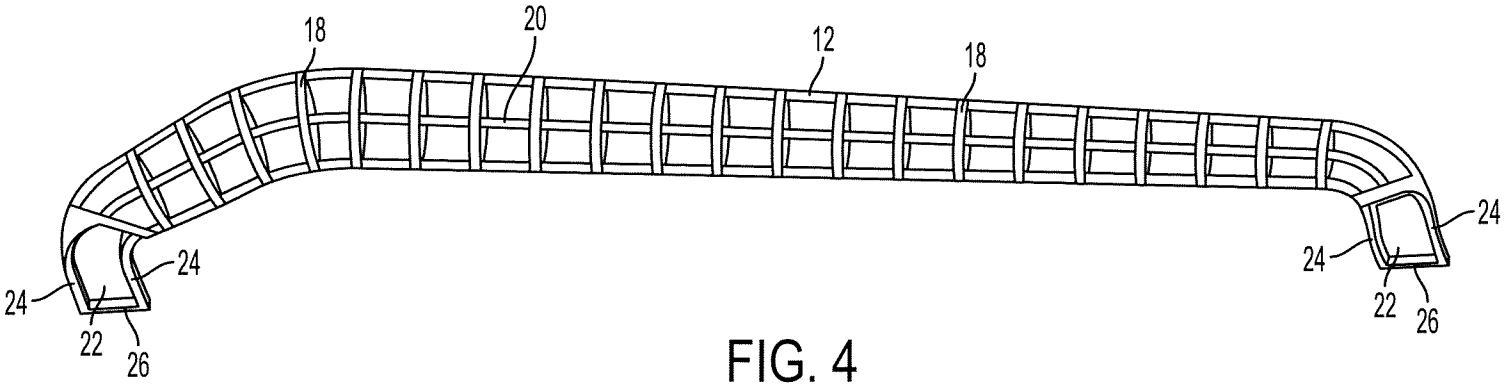
FIG. 4 shows a bottom or back side view of a body of the gear loop according to the present invention.

Generally, the gear loop 10 of the present invention may have a generally U shape body 12 when viewed from a top surface thereof. Generally, the U shape body 12 may have an elongated straight portion and a first and second arm that extend at a predetermined angle from the straight portion of the generally U shaped body 12. In one embodiment, one of the arms may extend a predetermined distance while the other arm may extend a predetermined distance from the opposite end of the straight portion of the body 12. One of the arms may be shorter in length than the opposite arm in one contemplated embodiment. However, it is also contemplated to have the arms extending from each end of the straight portion of the body 12 extend the same length. In one contemplated embodiment one of the arms may have a generally 90° angle from the straight portion of the body 12, while the other may generally have a 45° initial angle and then an additional 45° angle, which generally may define that each end of the body 12 may be a generally 90° or perpendicular to the generally straight portion of the body 12. The body 12 may have a generally circular or oval cross sectional shape, however it should be noted that any other shape may be used for the cross section of the body 12. Generally, the top surface of the body 12 may be a continuous shell or surface. In one contemplated embodiment the bottom surface or back side of the body 12 of the gear loop 10 may include a generally spine and rib configuration therein. As shown in FIG. 4, it may include a spine 20 that runs along an entire longitudinal mid point of the body 12. Spaced at predetermined intervals perpendicular to the spine 20 may be a plurality of ribs 18. Generally, the gear loop body 12 is molded of any known plastic material. In one contemplated embodiment it is molded from a UV stable plastic material. This UV stable plastic material may be, but is not limited to a polypropylene or nylon material. Hence, a plurality of ribs 18 may be arranged along a back side of the gear loop 10 according to the present invention. The first and second arms which in part form the ends of the gear loop body 12 generally may be flat. These ends may have a rectangular shape or any other known shape, and may have an angled surface that gradually reduces from a top side of the body 12 to the relatively flat end for each end of the gear loop body 12. Arranged at a center portion of the first and second end of the body is an orifice 22. The orifice 22 may pass through the first and second end of the gear loop body 12. Generally, the orifice 22 may have a rectangular shape, however any other shaped orifice 22 may be used within each end of the gear loop body 12. The orifice 22 may be defined on each end by a first and second finger 24 and a cross beam member 26 connecting the first and second finger 24 at their ends thereof. It should be noted that it is also contemplated to mold the body 12 in a complete solid body without the rib and spine configuration arranged on a back side thereof. It should also be noted that any other shape may be used for the body 12 other than the shape as shown in the drawings and described above. Generally, the U shape is the preferred shape for gear loops 10 on climbing harnesses 30 and tool belts. However, it is also contemplated to mold the body as a circle, triangle, square, semi-circle, oval or any other known or random shape contemplated for the gear loop body 12.

The use of the UV stable moldable plastic for the body 12 of the gear loop 10 may ensure that the gear loop 10 is more robust and longer lasting than the prior art nylon webbing gear loops. It should also be noted using a moldable UV stable plastic may allow for the gear loop 10 to be formed into any known shape depending on the design requirements and the climber needs for gear loops 10 on a climbing harness 30 or a tool belt harness. It should be noted that it is also contemplated to use any known material other than plastic to form the gear loop 10. These other materials may be but are not limited to any known metal, ceramic, composite, plastic, natural material or the like. It is also contemplated to use any known forming technique other than molding to form and shape the body 12 of the gear loop 10 according to the present invention, such as but not limited to any known extrusion method, forming method, or any other known manufacturing technique may be used to form the gear loop body 12 of the present invention. It should further be noted that any known color or multiple color scheme may be used to create the gear loop 10, thus providing personalization to the gear loops 10. It is also contemplated to have the gear loop 10 include words written thereon or other messages or pictures formed on the outer surface of the gear loop 10 to satisfy individual needs and personalization of the climber or other user using the gear loop 10.

The gear loop 10 of the present invention also may include an end member 14 arranged on both the first end and second end of the gear loop body 12. The end members 14 generally may be molded onto the first and second end of the gear loop body 12. It should be noted that any other manufacturing method other than molding may also be used to secure the end member 14 to the end of the body 12. An over molding technique of a second separate material onto the first and second end of the gear loop body 12 may allow for a hinge type effect or hinge to occur for the gear loop 10. The hinge effect, via the second material end member 14 over molded onto each end of the body 12, may allow for the gear loop 10 to fold back toward the climber when the climber is in tight quarters, thus reducing the wear against the rocks of the gear loop 10 and the equipment being held by the gear loop 10 one encounters during climbing activities or the like. In one contemplated embodiment, the end member 14 may be made of a thermoplastic elastomer (TPE). The thermoplastic elastomer generally is a copolymer that is a mix of a plastic and a rubber that is generally easy to manufacture by injection molding or the like. Thermoplastic elastomers typically may have advantages of both rubber and plastic materials, which may allow for the hinge type effect to occur for the gear loop 10 according to the present invention. Generally, the end members 14 may be molded such that they encapsulate and completely cover the first and second ends of the gear loop body 12. The over molding of the end member 14 and the complete encapsulation of the first and second ends of the body 12 may ensure a robust connection between the end member 14 and the body 12, thus allowing for the gear loop 10 to be securely fastened to the waist band 34 of the climbing harness 30 or the like. The use of the TPE material for the end member 14 may allow for a type of hinge to be formed on each end of the body 12, thus allowing for the gear loop 10 to fold back toward the climber as discussed above. It should be noted that any other known material may be used for the end member 14 other than TPE, such as but not limited to any hard or soft plastic, metal, ceramic, composite, or any other natural material which may display similar properties and may allow for a hinge type effect to occur in conjunction with the body 12 of the gear loop 10. Also, it is contemplated to use any known mechanical hinge on the gear loop body 12. Generally, the end member 14 may have a rectangular shape or any other known shape, which generally mimics the first and second end of the gear loop 10. The end member 14 may also include a predetermined thickness, which mimics the body from the generally circular cross section of the main body portion and then may taper down to a relatively flat end portion of the first and second ends of the gear loop body 12. Hence, the end member 14 generally may have a flat surface near one end thereof and may be a generally flat member, but not completely flat when over molded onto the first and second end of the gear loop body 12. It should be noted that any known color or multiple colors may be used for the end members 14 of the present invention. The end member 14 generally may have a predetermined spring co-efficient which may determine the flexibility and hinge effect the gear loop 10 may have. It should be noted that any variety or type of TPE may be used to over mold the end members 14 onto the gear loop body 12. The end member 14 may also include a slot or opening 16 arranged at generally a mid point near one end of the end member 14. The slot 16 generally may be rectangular or oval in shape, however, any other random or known shape may also be used. The slot 16 as discussed above, is generally arranged at a mid point or mid line of the end member 14, however the slot 16 may be arranged at any other position therein. The slot 16 may be parallel to the fingers 24 of the body 12 of the gear loop 10 or may be perpendicular to the fingers 24 of the gear loop 10 depending on the design requirements and climbing harness 30 the gear loop 10 may be used thereon. It is also contemplated to have multiple slots arranged therein in multiple configurations. It is also contemplated that the end member 14 may be designed and used without a slot 16.

Generally, when securing the gear loop 10 to the waist band 34 of the harness 30, a thread may be sewn through the end member 14 alone or through the end member 14 and the slot 16 of the end member 14 into a predetermined portion of the waist band 34 of the climbing harness 30. It should be known that any known sewing technique and thread may be used to secure each end of the gear loop 10 to the waist band 34 and that the gear loop 10 may be arranged in any known orientation with respect to the waist band 34 of the climbing harness 30. Therefore, in operation the gear loops 10 may be used in any known harness, belt or the like for any recreational or commercial purpose, such as but not limited to police belts, firemen belts, rescue belts, climbing harnesses, wind surfing harnesses or any other known harness both commercial or recreational in use. It is also contemplated that any known plastic material or any other known material may be used for the body 12 and that any known TPE material or the like may be used for the end member 14 of the gear loop 10 according to the present invention. Any and all known color combinations and advertising may be molded onto or imprinted on the outer surfaces of the gear loop 10. Generally, the gear loops 10 are not designed and not secured to a harness 30 to be used to support the weight of the user of the harness 30, however it is contemplated to reinforce this securing of the gear loop 10 to the harness 30 to allow for the gear loops 10 to be used in emergency situations as rescue loops to help support the weight of an injured climber or other user using the climbing harness or belt 30. It should further be noted that the end member 14 may be formed and over molded in any known shape other than the rectangular shape as shown. It may be formed and over molded in a triangular shape, a square shape, a circular shape, or any other known or random shape depending on the design requirement of the climbing harness 30 onto which the gear loop 10 may be used.

The present invention has been described in an illustrative manner. It is to be understood that the terminology which has been used is intended to be in the nature of words of description rather than that of limitation.

Many modifications and variations of the present invention are possible in light of the above teachings. Therefore, within the scope of the appended claims, the present invention may be practiced otherwise than as specifically described.

What is claimed is:

1. A gear loop, said gear loop comprising:

a generally U shaped body, said body is made of a first predetermined material, said body having a first end and a second end;

a first end member attached to said first end of said body;

a second end member attached to said second end of said body, said first and second end members are made of a second predetermined material; and said second predetermined material of said first and second end members provides a hinge type effect for the gear loop which allows the gear loop to fold back toward a user of the gear loop.

2. The gear loop of claim 1 wherein said body having a first orifice arranged at said first end and a second orifice arranged at said second end.

3. The gear loop of claim 2 wherein said first end member encapsulates said first end and said second end member encapsulates said second end.

4. The gear loop of claim 1 wherein said body having a spine and rib configuration on a backside.

5. The gear loop of claim 4 wherein the spine is generally aligned along a mid point of said body.

6. The gear loop of claim 1 wherein said first end and said second end are generally flat and have a rectangular shape, said first end having a first and second finger, said first end having a cross beam arranged between and perpendicular to said first finger and said second finger.

7. The gear loop of claim 1 wherein said body having a generally circular shape when viewed in cross section.

8. The gear loop of claim 1 wherein said first predetermined material is a UV stable plastic.

9. The gear loop of claim 8 wherein said first predetermined material is a polypropylene or nylon.

10. The gear loop of claim 1 wherein said second predetermined material is a thermoplastic elastomer.

11. The gear loop of claim 1 wherein said first end member is molded over said first end and said second end member is molded over said second end.

12. The gear loop of claim 1 wherein said end members having a generally rectangular shape.

13. The gear loop of claim 1 wherein said end members having a slot therethrough.

14. The gear loop of claim 13 wherein said slot is generally arranged at a midpoint of said end members.

15. The gear loop of claim 1 wherein the gear loop is for use in a climbing harness, recreational harness, work belt or tool belt.

* * * * *